US010266369B2

(12) United States Patent
Sonnenmoser et al.

(10) Patent No.: US 10,266,369 B2
(45) Date of Patent: Apr. 23, 2019

(54) ENERGY-AUTONOMOUS ELEVATOR SYSTEM CONTROL ELEMENT AND ELEVATOR SYSTEM INCLUDING THE CONTROL ELEMENT

(71) Applicant: Inventio AG, Hergiswil (CH)

(72) Inventors: Astrid Sonnenmoser, Hochdorf (CH); Christoph Liebetrau, Menziken (CH); Martin Kusserow, Lucerne (CH); Thomas Hartmann, Kleinwangen (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/501,459

(22) PCT Filed: Jul. 1, 2015

(86) PCT No.: PCT/EP2015/064989
§ 371 (c)(1),
(2) Date: Feb. 3, 2017

(87) PCT Pub. No.: WO2016/020123
PCT Pub. Date: Feb. 11, 2016

(65) Prior Publication Data

US 2017/0217725 A1 Aug. 3, 2017

(30) Foreign Application Priority Data

Aug. 4, 2014 (EP) ..... 14179745

(51) Int. Cl.
*B66B 1/06* (2006.01)
*B66B 1/34* (2006.01)
(Continued)

(52) U.S. Cl.
CPC ..... *B66B 1/3461* (2013.01); *B66B 1/34* (2013.01); *B66B 1/462* (2013.01); *B66B 3/002* (2013.01)

(58) Field of Classification Search
CPC ..... B66B 1/3461; B66B 1/34; B66B 1/462; B66B 3/002
(Continued)

(56) References Cited

U.S. PATENT DOCUMENTS 4,600,087 A * 7/1986 Tsuji ..... B66B 1/462 187/382
4,805,739 A * 2/1989 Lind ..... B66B 1/462 187/394
(Continued)

FOREIGN PATENT DOCUMENTS

CN 1608022 A 4/2005
CN 101443827 A 5/2009
(Continued)

*Primary Examiner* — Jeffrey Donels
(74) *Attorney, Agent, or Firm* — William J. Clemens; Shumaker, Loop & Kendrick, LLP

(57) ABSTRACT

An energy-autonomous elevator system control element includes a piezoelectric layer and processing unit for detecting a control operation, a transmitting unit for wirelessly transmitting at least one signal to a remote elevator system controller, the at least one signal being generated automatically by the elevator system control element on the basis of the control operation, and an energy recovery unit for supplying electrical energy for the elevator system control element. The energy-autonomous elevator system control element can be used as a car operating panel or a landing operating panel in an elevator system.

15 Claims, 3 Drawing Sheets

(51) Int. Cl.
*B66B 3/00* (2006.01)
*B66B 1/46* (2006.01)

(58) Field of Classification Search
USPC ..... 187/290
See application file for complete search history.

(56) References Cited

U.S. PATENT DOCUMENTS

| | | | | |
|---|---|---|---|---|
| 5,040,640 | A * | 8/1991 | Slabinski | B66B 1/462 187/380 |
| 6,747,573 | B1 * | 6/2004 | Gerlach | G08C 17/02 340/870.21 |
| 8,253,548 | B2 * | 8/2012 | Oh | B66B 1/34 187/395 |
| 9,837,860 | B2 * | 12/2017 | McCarthy | B66B 1/34 |
| 2003/0116385 | A1 * | 6/2003 | Valk | B66B 1/34 187/391 |
| 2005/0073221 | A1 | 4/2005 | Albsmeier et al. | |
| 2009/0295550 | A1 * | 12/2009 | Oh | B66B 1/34 340/286.06 |
| 2015/0314984 | A1 * | 11/2015 | McCarthy | H02J 7/025 187/413 |

FOREIGN PATENT DOCUMENTS

| | | | |
|---|---|---|---|
| DE | 202006011196 | U1 | 10/2006 |
| JP | 2009506965 | A | 2/2009 |
| KR | 20040063941 | A | 7/2004 |
| WO | 03055779 | A1 | 7/2003 |
| WO | 2007030109 | A2 | 3/2007 |

* cited by examiner

ENERGY-AUTONOMOUS ELEVATOR SYSTEM CONTROL ELEMENT AND ELEVATOR SYSTEM INCLUDING THE CONTROL ELEMENT

FIELD

The invention relates primarily to a control element for an elevator system, designated hereafter as an elevator system control element, or in short, a control element.

BACKGROUND

Such control elements are known per se and in the specialist terminology are designated by COP (car/cabin operating panel) and LOP (landing operating panel).

The basic principles of operation of an elevator system are known per se, and therefore require no detailed explanation here: a user of the elevator system uses operating panels of the above-mentioned type to initiate a landing call or a car call. An elevator system controller receives signals generated as a result of a landing or car call and initiates a movement of an elevator car, which forms part of the elevator system, to satisfy the landing or car call.

The wiring of each control element to the elevator system controller, which has up to now been necessary, becomes redundant if the signals generated as a result of a landing or car call are transmitted wirelessly to the elevator system controller. Even such a wireless signal transmission still requires wiring of each control element however, to supply it with power.

SUMMARY

An object of the present invention accordingly consists in creating a control element which operates completely without any external wiring.

This object is achieved by means of an energy-autonomous elevator system control element (control element) that comprises means for detecting a control operation and means for the wireless onward transmission of at least one signal, which can be generated automatically by the elevator system control element on the basis of the control operation, to a remote elevator system controller. In accordance with the invention, it is also provided that the elevator system control element comprises a unit for recovering energy, designated hereafter as an energy recovery unit.

The advantage of the embodiment of the elevator system control element according to the invention is that the energy recovery unit comprised by the elevator system control element makes the elevator system control element into an energy-autonomous elevator system control element. There is therefore no longer any need to provide wiring between the elevator system control element, hereafter abbreviated to control element, and the energy supply. Due to the wireless transfer of an automatically generated signal to the respective elevator system controller on the basis of a control operation, the control element is in fact operable without external wiring, and as a result is very simple and straightforward to install. The energy-autonomous control element is thus also especially suitable for retrofitting or upgrading an elevator system.

An energy recovery unit, or a part of such an energy recovery unit, can be implemented by units which include, individually or in combination, a photovoltaic module (solar cell), an induction coil and/or a piezoelement, or a multiplicity of such units. By means of a photovoltaic module or a plurality of photovoltaic modules, the ambient light, i.e. natural light and/or artificial light, can in a known manner be utilized for generating electrical energy. An induction coil may be used as a receiver in an electromagnetic energy transmission, so that electrical energy can be fed into the energy-autonomous control element and the induction coil, or a group of induction coils, acts as an energy recovery unit. For the transmitter in such an electromagnetic energy transfer, for example, a mobile phone or similar item carried by the user of the elevator system could be considered. Finally, in addition or alternatively, a piezoelement or a group of piezoelements could be used as an energy recovery unit. As is well known, a mechanical force exerted on a piezoelement gives rise to an electrical voltage across the piezoelement, so that control operations, which the user of the elevator system carries out by pressing on individual sections of the control element, can be used for generating electrical energy, and therefore the piezoelement, or each of them together, acts as an energy recovery unit.

In a specific embodiment, the energy-autonomous control element comprises an energy accumulator, which can be supplied with electrical energy from the energy recovery unit. In the event that excess electrical energy is generated by the energy recovery unit, this energy can be temporarily stored in the energy accumulator and retrieved again when required.

An embodiment of an energy-autonomous control element of the type previously described is characterized by a layer-like structure, wherein the control element comprises a configurable display unit in a first layer and the energy recovery unit in another layer. Such a layer-like structure is advantageous because it means that the display unit and the energy recovery unit—not necessarily in this order—can be arranged, so to speak, one after the other, wherein the whole surface area or substantially the whole surface area of the control element is available for the display unit and the energy recovery unit. As large a usable area as possible is advantageous, both for a photovoltaic module acting as an energy recovery unit as well as for the display unit. In addition, with such a layer-like structure of the control element a plurality of energy recovery units can easily be combined, for example a photovoltaic module in a layer above a display unit and a piezoelement in a further layer, for example underneath the display unit. Such a piezoelement or group of piezoelements can at the same time optionally act as a means for detecting a control operation and as an (additional) energy recovery unit.

In a further embodiment of an energy-autonomous control element of the previously described type, which comprises a local energy recovery unit for supplying electrical energy, the focus is placed on reducing the energy requirement as much as possible. For this purpose it is provided that the energy-autonomous control element comprises a display unit which is based on a display technology that does not require a permanent energy supply. Examples of such a display unit are a device with an interferometrically operating modulator (IMOD; interferometric modulator display) or a device which functions on the basis of electrophoresis. A keyword in this context is that of e-paper (electronic paper). In a display unit based on electrophoresis, as is known, colored particles contained in a viscous polymer are aligned by brief application of an electrical voltage, wherein a display obtained in this way remains stable even after removal of the electrical voltage, i.e. without a permanent voltage, over a period of several weeks. In the case of a display unit with an interferometric modulator, as is known, a distance between two reflective layers relative to each other is electrically modified, wherein a point in the image appears as either light/visible or dark/invisible, due to constructive or destructive interference, depending on a distance obtained. When the reflective layers have assumed their desired position, their condition is stable, i.e. the display unit requires no additional energy as long as the image does not change. This means that the energy requirement of the energy-autonomous control element is significantly reduced. In addition, a control element with a display unit of the above described type has the advantage that e-paper displays are very robust against damage, because such a display unit works, for example, even after being punctured.

The energy-autonomous elevator system control element can also be designed in a form in which it can be connected to an external power supply. In that case, the supply of electrical energy to the elevator system control element is normally effected by means of the external voltage supply, wherein in the event of a failure of the external voltage supply the elevator system control element automatically switches over to an energy-autonomous operation until the external power supply is restored. Alternatively, it can also be provided that the elevator system control element is normally operated as an energy-autonomous elevator system control element and the external voltage supply is used only if the energy recovery unit is not supplying any electrical power, or has not supplied any electrical energy for a specified or specifiable period of time, and/or an energy accumulator comprised by the elevator system control element is approaching a critical charging state.

Overall, the invention is also an elevator system having at least one such energy-autonomous elevator system control element.

In the following, an exemplary embodiment of the invention is explained in more detail based on the drawings. Equivalent objects or elements are assigned the same reference numerals in all figures.

The exemplary embodiment is not to be understood as a limitation of the invention. Rather, within the context of this disclosure, additional features and modifications are also possible which are evident to the person skilled in the art in regard to achieving the object of the invention, in particular those which, for example, by combination or variation of individual features or elements or method steps described in connection with the general or specific description section and contained in the claims and/or the drawing, and which by combinable features lead to new subject matter or to new methods or sequences of method steps.

DESCRIPTION OF THE DRAWINGS

The above as well as other advantages of the invention will become readily apparent to those skilled in the art from the following detailed description of a preferred embodiment when considered in the light of the accompanying drawings in which.

DETAILED DESCRIPTION

Figure 1:
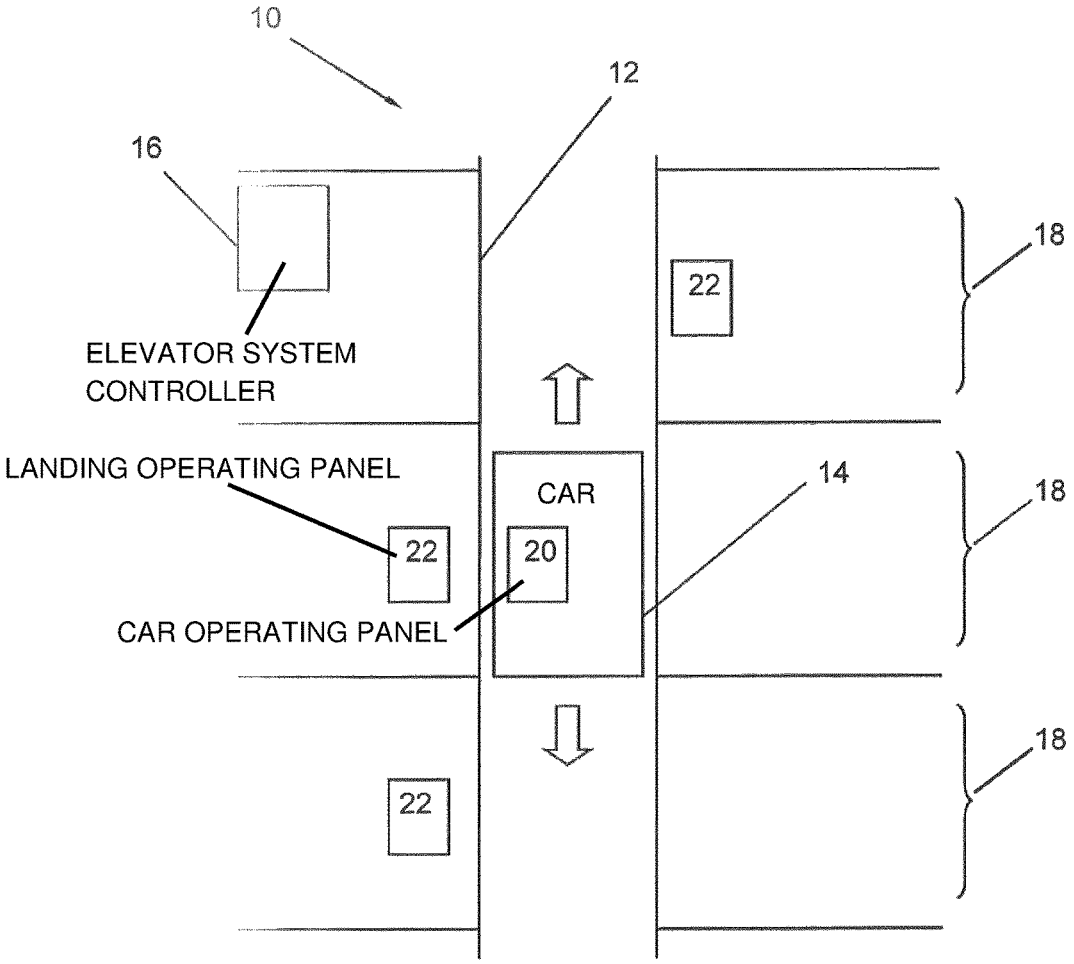
FIG. 1 is a schematic diagram of an elevator system having an elevator system controller, an elevator car and individual operating panels.

The illustration in FIG. 1 shows a simplified schematic diagram of an elevator system 10 in a building, not itself shown, having at least one elevator car 14 that can move in at least one elevator shaft 12, and having an elevator system controller 16 provided at a central point of the building. The elevator system controller 16 is provided for controlling the elevator system 10 in a known manner. The, or each, elevator car 14 is moveable in a known manner in the elevator shaft 12 or in the respective elevator shaft 12, so that different landings 18 of the building are accessible.

The elevator system 10 comprises operating panels 20, 22, namely a car operating panel 20 (COP; car/cabin operating panel) in the elevator car 14 and landing operating panels 22 (LOP) on individual landings 18.

In accordance with the approach proposed here, at least some individual operating panels 20, 22 are designed as energy-autonomous elevator system control elements and the following description is continued based on the example of a car operating panel 20 as such an energy-autonomous elevator system control element. Within the elevator system 10, all landing operating panels 22 and the or each car operating panel 20 can be implemented as energy-autonomous elevator system control elements, so that hereafter, for energy-autonomous elevator system control elements the reference numerals previously introduced for the car operating panel 20 and the floor panels 22 are used.

Figure 2:
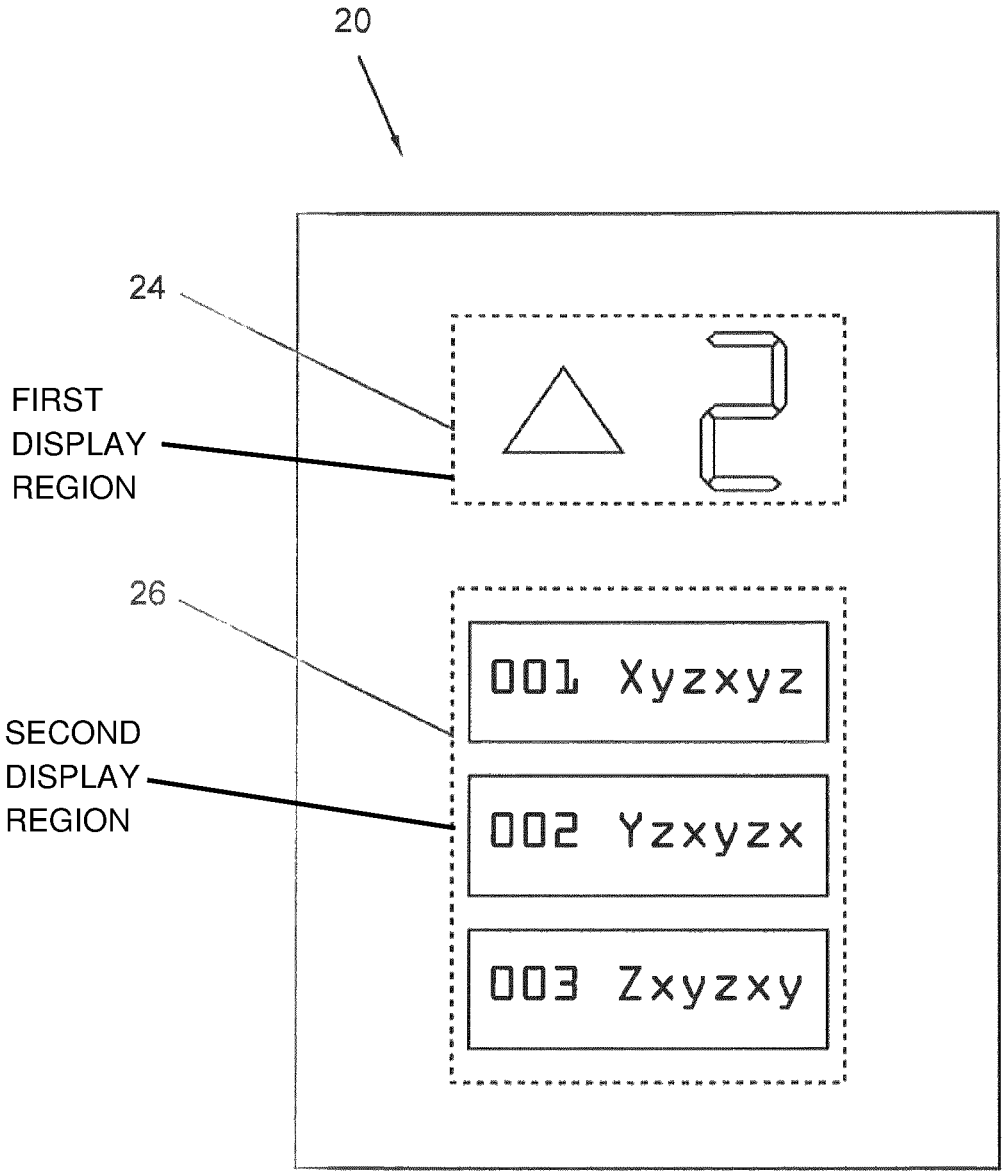
FIG. 2 shows a front face of an operating panel of an elevator system.

The illustration in FIG. 2 shows—schematically and much simplified—a plan view of an energy-autonomous elevator system control element 20 which is acting as a car operating panel 20, and which is hereafter occasionally only designated in brief as a control element 20. On its front side the control element 20 comprises, for example, two regions 24, 26, namely a first region 24 for displaying a respective position and direction of travel of the elevator car 14 or the like, and a second region 26 for performing operating actions, namely here the initiation of a car call.

Figure 3:
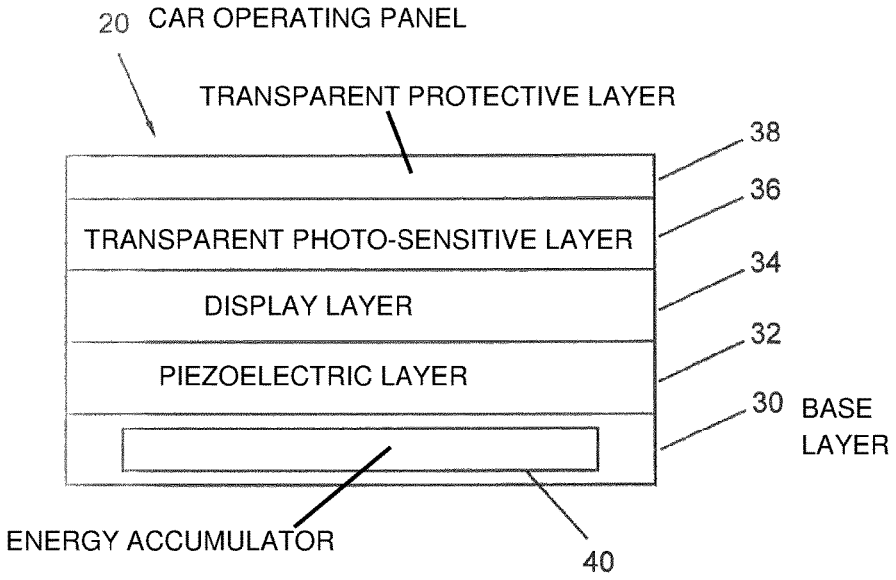
FIG. 3 shows a sectional detail of a control element, here suggested as an operating panel.

The illustration in FIG. 3 shows an embodiment of an energy-autonomous elevator system control element 20 in a sectional detail and a simplified side view. From this, the layer-like structure of the control element 20 is clearly identifiable. The embodiment illustrated also comprises optional layers. The illustration in FIG. 4, on the other hand, shows the control element 20 in the form of a schematically simplified block diagram.

In accordance with the illustration in FIG. 3, the control element 20 comprises a base layer 30 acting as a substrate or structural element, a piezoelectric layer 32 located above it which is in principle optional, a further display layer 34 located above that, an in principle optional transparent photo-sensitive layer 36 located above the display layer 34 and a transparent protective layer 38 located above the photo-sensitive layer 36. The protective layer 38 is also in principle optional. The protective layer 38 is practical if the control element 20 needs to be protected against, for example, moisture and other environmental influences, but also against damage such as scratches and the like. Without such a protective layer 38, a surface of what is then the external layer assumes at least in part the function of the protective layer 38.

In the embodiment shown, the base layer 30 also acts as a site for accommodating an energy accumulator 40, for example in the form of one or more batteries, accumulators, capacitors, Super Caps or the like.

The piezoelectric layer 32 acts as a means for detecting an input or other control operation—hereafter grouped together under the term control operation—by a user of the elevator system 10. As a control operation the user presses, for example, on a flat section in the second region 26 (FIG. 2) on the front side of the control element 20, in order thus to select a desired target landing. The force exerted due to pressing on the front side of the control element 20 gives rise to an electrical voltage across one or more piezoelements (not shown separately), which comprise the piezoelectric layer 32. Accordingly, on the basis of the resulting voltage the location of the contact can be automatically determined and accordingly—also automatically—on the basis of the control operation a signal 42 (see FIG. 4) can be generated which is transmitted wirelessly to the elevator system controller 16 by means of the control element 20 for the car call, where it is processed in a known manner.

To provide wireless transmission of such a signal 42, the control element 20 comprises a transmitting unit 44, in particular a combined transmitting/receiving unit 44. This is activated by means of a processing unit 46 which the control element 20 comprises. The processing unit 46 and the transmitting unit 44 or the transmitting/receiving unit 44—in the interests of better readability, but without sacrificing any further general validity, the following description continues with the example of a control element 20 with a transmitting/receiving unit 44—are supplied with electrical power by means of an energy recovery unit 48, which the control element 20 also comprises, and possibly also from the energy accumulator 40.

The processing unit 46 comprises in a known manner an ASIC (application-specific integrated circuit), a micro-processor 50 or the like and a memory 52, into which a control program can be loaded which is executed by the microprocessor 50 during the operation of the control element 20. The evaluation of a particular control operation, the generation of a corresponding signal 42 and the activation of the transmitting/receiving unit 44 for wireless transmission of the signal 42 are all carried out under monitoring by the control program.

The piezoelectric layer 32 mentioned can be used as an energy recovery unit 48 either on its own or in combination, because the electrical voltage resulting from a control operation can also be used for supplying electrical power to the processing unit 46 and the transmitting/receiving unit 44. In the embodiment of the control element 20 shown in FIG. 3 having a photo-sensitive layer 36, the latter acts as a photovoltaic module and therefore also as an energy recovery unit 48. Any voltage induced as a result of incident ambient light is available for supplying electrical power to the processing unit 46 and to the transmitting/receiving unit 44. Alternatively or additionally, the control element 20 can also comprise, for example in the base layer 30, one or more induction coils (not shown) as receivers of electromagnetically transmitted energy, wherein in such a case the induction coils or the totality of the induction coils also act as an energy recovery unit 48, since by means of a transmitter, for example carried by the user, energy can be fed into the operator control element 20 in a known manner by wireless means, which energy can be tapped as an electrical voltage across the or each induction coil and used to supply electrical energy to the processing unit 46 and the transmitting/receiving unit 44.

The display layer 34 acts as a display unit 54 that can also be supplied with electrical energy by means of the energy recovery unit 48, and the activation of the display unit 54 is effected under monitoring by the control program by means of the processing unit 46. By means of the display unit 54, a visual feedback signal is provided to the user in a known manner, either immediately following the control operation or immediately following an evaluation of a signal 42 which is generated as a result of the control operation. Such a feedback signal is typically transmitted wirelessly by the elevator system controller 16 via the transmitting/receiving unit 44 to the control element 20 and displayed by the display unit 54 thereof. Additionally or alternatively, such a feedback signal can also be provided to the user as haptic feedback by means of the piezoelectric layer 32. The user is then informed, for example by means of a vibration of the control element 20, that the control operation has been registered and already evaluated by the elevator system controller 16. The activation of the piezoelectric layer 32 for generating such a haptic feedback signal is preferably effected using the electrical energy supplied by the energy recovery unit 48. Depending on the amount of the available electrical energy, a duration and/or intensity of the haptic feedback can be automatically adjusted by the control element 20, namely the processing unit thereof. If the available electrical energy is not sufficient for a minimal haptic feedback signal, the system falls back on the energy stored in the energy accumulator 40 in order to generate the haptic feedback.

Figure 4:
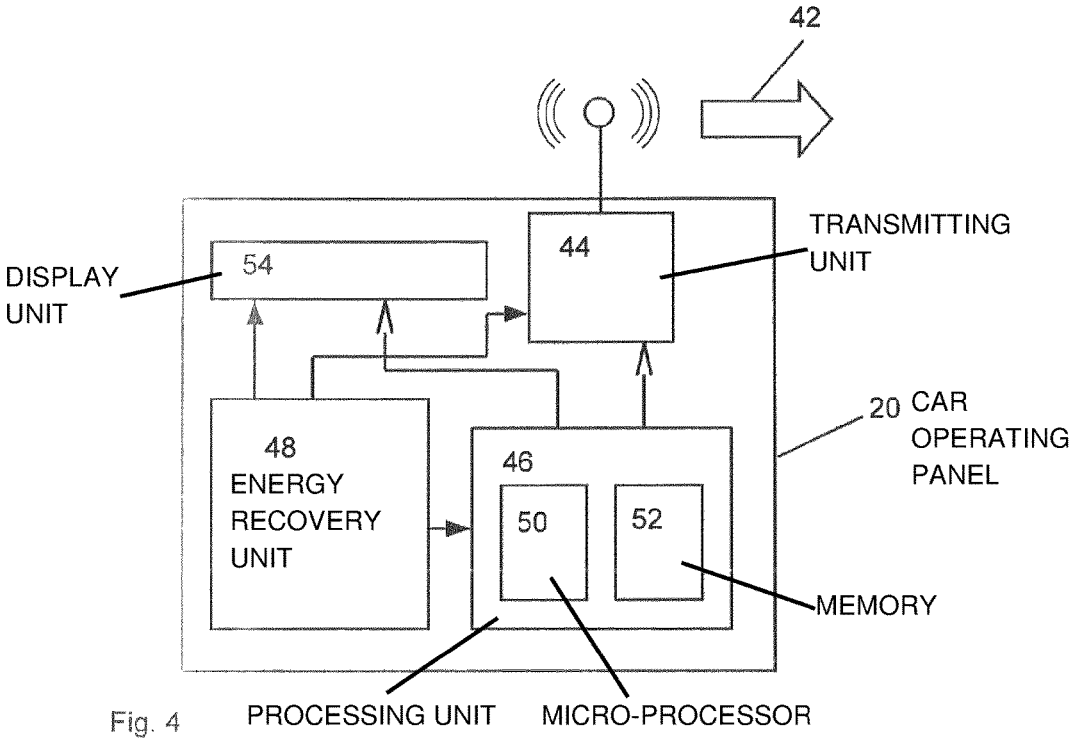
FIG. 4 is an illustration of such a control element as a block diagram.

The electrical energy supply to the processing unit 46, the transmitting/receiving unit 44 and the display unit 54 by means of the energy recovery unit 48 is illustrated in the drawing of FIG. 4 in the form of arrows, which each emanate from the energy recovery unit. The activation of the transmitting/receiving unit 44 and the display unit 54 by means of the processing unit 46 is also illustrated in the form of arrows in the drawing of FIG. 4, namely by arrows each emanating from the processing unit 46.

In the interests of a minimal electrical energy consumption by the energy-autonomous control element 20, the display unit 54 is based on a display technology that does not require a permanent energy supply. On this point, to avoid repetition reference is made to the remarks given above. By enabling any user information displayed by means of the display unit 54 to remain stable even after removal of the permanent energy supply (keyword: e-paper), by retrieving electrical energy from the energy recovery unit 48 and/or the energy accumulator 40, the energy consumption of the operating panel 20 in continuous operation is kept to a minimum.

If the energy recovery unit 48 does not supply any electrical power, this is not problematic at first. If the control program of the processing unit 46 is not fully executed due to a lack of electrical power, the existing displays of the display unit 54 remain in place. Furthermore, the execution of the control program and the operation of the processing unit 46 combined automatically begin again immediately, as soon as the energy recovery unit 48 supplies electrical power.

This can be the case, for example, if the user of the elevator system 10 activates a light due to a motion alarm or the like, which supplies sufficient ambient light that a photovoltaic module, acting as an energy recovery unit 48 or as part of such an energy recovery unit 48, supplies electrical power. If permanent adequate lighting can be assumed in the region of the energy-autonomous control element 20, then the supply of power to the control element 20 by means of a photovoltaic module acting as an energy recovery unit 48, or as part of an energy recovery unit 48, is not a problem in any case. If the control element 20 has no photovoltaic module or if permanently adequate lighting is not guaranteed, the user of the elevator system 10 can act directly or indirectly, so to speak, as an energy source. If the control element 20 is designed as a pressure-sensitive control element 20 with a piezoelectric layer 32, and piezoelements comprised thereby act as an energy recovery unit 48 or as part of an energy recovery unit 48, then by his/her control operation the user "wakes up", so to speak, a control element 20 again, which has become inactive due to a lack of electrical power. As soon as the energy recovery unit 48 provides sufficient electrical energy for operation of the other functional units 46, 44, 54 of the control element 20, the control element 20 is functional again and can respond to control operations of the user. If the control element 20 has one or more induction coils as a receiver for an electromagnetic energy transmission, the activation ("waking up") of the control element 20 can take place unnoticed by the user by means of a transmitter carried by the user. The transmitter, for example a user's mobile phone or similar device, in this case emits electromagnetic waves in a known manner, which are received by the or each induction coil of the control element 20 and give rise to an electrical voltage that can be used for the operation of the functional units 46, 44, 54 mentioned above.

In the case of a control element 20 having a transmitting/receiving unit 44, the control operation in relation to the elevator system 10 can also be effected by means of a transmitter carried by the user, for example, a mobile phone or the like. A piezoelectric layer 32 or the like on the control element 20 is then unnecessary. Data relating to the control operation, which is performed for example on the mobile phone, are then transmitted by wireless means, for example according to the so-called NFC (near-field communication) standard, from the respective transmitter to the control element 20 and received there by means of the transmitting/receiving unit 44. The electromagnetic waves emitted can also be used for supplying energy to the functional units 46, 44, 54 of the control element 20 by means of one or more induction coil or coils comprised by the control element 20. Furthermore, the wireless transmission of electrical energy can also be effected in the course of an authentication of a user, which is known in principle, by means of a transmitter carried by the user. Such a transmitter sends out a code which is intended for authentication. As soon as the transmitter is in the sensing range of the control element 20, the electromagnetic waves emitted are used for supplying power to the functional units 46, 44, 54 of the control element 20 by one or more induction coils comprised by the control element 20. As soon as these are adequately supplied with electrical power, the code transmitted for the purpose of authentication is checked, and the use of the control element 20 is enabled to the respective extent. In the same way that information can be transmitted wirelessly to the control element 20, it is also possible to transmit information, in principle in a known manner, by wireless means from the control element 20 to a corresponding receiver, thus for example, a mobile phone of the user. In such a communication relationship, the control element 20 acts as a transmitter and transmits, for example, its own data or data from the elevator system controller 16.

Excess electrical energy generated by means of the energy recovery unit 48 during operation can be fed into the energy accumulator 40, where it can be retrieved again as required.

In the case of a control element 20 having a transmitting/receiving unit 44, the transmitting/receiving unit 44 can also be used for configuring the control element 20. By means of a transmitter communicating with the transmitting/receiving unit 44, a control program and/or data for the display unit 54 can be loaded into the memory 52 of the processing unit 46. The data for the display unit 54 can include data which determine the representation—thus, for example, the layout of such a representation—that can be effected using the display unit 54, for example, the number of selectable floors and their representation.

In the interests of reducing the energy consumption of an energy-autonomous elevator system control element 20, 22 in continuous operation, in a particular embodiment of the control element 20, 22 it is provided that the display unit 54 is activated as little as necessary. While hitherto the representation generated by an operating panel 20, 22 can often be interpreted in the broadest sense as an animation of the motion of the elevator car 14, in such a way that, for example, the particular landing number is displayed according to the current position of the elevator car 14, the aim here is to reduce the number of changing displays. Thus it is sufficient, for example, to represent a moving elevator car 14 simply by a directional arrow. Such a representation does not need to be changed when the elevator car 14 passes different landings 18. Because in a display unit 54 based on a display technology that does not require a permanent energy supply, electrical energy is only required when the displayed image changes, by reducing the number of changing displays the energy consumption is further reduced, so that the electrical power available from the particular energy recovery unit 48 is sufficient to supply the processing unit 46 and the transmitting/receiving unit 44 of the control element 20, 22 for a longer time.

The control element 20, 22 acting as an energy-autonomous elevator system control element 20, 22 is easy to install, because no wiring is necessary either to provide the energy supply for the control element 20 or to transmit data to or from the control element 20. An energy-autonomous elevator system control element 20, 22 consumes no electrical energy which needs to be externally supplied from the elevator system 10, and therefore reduces the energy required by the elevator system 10. The energy-autonomous elevator system control element 20, 22, which is equipped for wireless data transmission without the need for external wiring, can be easily configured by wireless means and adapted to suit modified requirements. This can be carried out on site and also by operators with little training, because such a configuration in effect reduces to the establishment of a wireless data transfer between a particular transmitter, for example a portable computer or the like, and the particular control element 20, 22.

Without the need for external wiring, the use of one or more energy-autonomous elevator system control elements 20, 22 is also especially applicable to the retrofitting/upgrading of an elevator system 10. Installing such a control element 20, 22 does not involve any drilling of holes or the like. If the elevator system 10, for example, does not have sufficiently wide door pillars to receive a control element 20, 22, then the control element 20, 22, can also be readily installed near to such door pillars. The control element 20, 22 does not necessarily require a flat surface for installation either, so that the installation options are increased, and owing to the use of flexible elastic layers 30-38, the control element 20, 22 can also be installed on rounded walls or the like. All of these advantages and the associated time savings obtained when installing control elements 20, 22, and of course the resulting additional freedom, for example with regard to the placement site, also applies to the installation of a new elevator system 10.

Individual key aspects of the description submitted here can therefore be briefly summarized as follows: specified are an energy-autonomous elevator system control element 20, 22, having means 32, 46 for detecting a control operation and means 44 for the wireless onward transmission of at least one signal 42, which can be generated automatically by the elevator system control element 20, 22 on the basis of the control operation, to a remote elevator controller 16, and having an energy recovery unit 48 comprised by the elevator system control element 20, 22 and an elevator system having such an energy-autonomous elevator system control element 20, 22. In addition, different methods for operating such an elevator system control element 20, 22 are specified, for example an operating method for energy recovery by means of a piezoelement or a piezoelectric layer 32, an operating method for energy recovery by means of a photovoltaic module or a photosensitive layer 36 and/or an operating method for energy recovery by means of at least one induction coil acting as a receiver of electromagnetically transmitted energy, wherein the electromagnetic energy transmission takes place, for example, in conjunction with an already intended data transmission, for example in conjunction with an authentication of a user or similar operation.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An energy-autonomous elevator system control element comprising:

means for detecting a control operation, including means for wireless reception of a signal defining the control operation, where the control operation is selected by a user on a mobile phone and the signal is wirelessly transmitted from the mobile phone;

means for wireless transmission of at least one signal to a remote elevator system controller in response to detection of the control operation by the means for detecting; and an energy recovery unit supplying electrical power to the means for detecting and the means for wireless transmission wherein the control element operates without external wiring, where the control element has a layer-like structure with a configurable display unit in one layer and the energy recovery unit in another layer, and the display unit layer and the energy recovery unit layer each occupy substantially an entire surface area of the control element.

2. The energy-autonomous elevator system control element according to claim 1 wherein the energy recovery unit includes at least one photovoltaic module.

3. The energy-autonomous elevator system control element according to claim 1 wherein the energy recovery unit includes at least one piezoelement.

4. The energy-autonomous elevator system control element according to claim 1 wherein the energy recovery unit includes at least one induction coil.

5. The energy-autonomous elevator system control element according to claim 1 including an energy accumulator supplied with electrical power from the energy recovery unit.

6. The energy-autonomous elevator system control element according to claim 1 wherein the display unit is supplied with electrical power from the energy recovery unit and information displayed by the display unit remains stable after the electrical power is removed from the display unit.

7. The energy-autonomous elevator system control element according to claim 1 having a piezoelectric layer as the means for detecting and wherein the piezoelectric layer also functions as the energy recovery unit.

8. An elevator system having at least one energy-autonomous elevator system control element according to claim 1 operating as a car operating panel or a landing operating panel.

9. An energy-autonomous elevator system control element comprising:

a base layer;

a display layer located on the base layer;

means for detecting a control operation, including means for wireless reception of a signal defining the control operation, where the control operation is selected by a user on a mobile phone and the signal is wirelessly transmitted from the mobile phone, the means for detecting being the display layer or a piezoelectric layer located between the base layer and the display layer, where the base layer, the display layer and the piezoelectric layer each occupy substantially an entire surface area of the control element;

means for wireless transmission of at least one signal to a remote elevator system controller in response to detection of the control operation by the means for detecting; and an energy recovery unit supplying electrical power to the means for detecting and the means for wireless transmission wherein the control element operates without external wiring.

10. The energy-autonomous elevator system control element according to claim 9 including a transparent photo-sensitive layer located on the display layer.

11. The energy-autonomous elevator system control element according to claim 10 including a transparent protective layer located on the transparent photo-sensitive layer.

12. The energy-autonomous elevator system control element according to claim 9 including an energy accumulator accommodated in the base layer.

13. The energy-autonomous elevator system control element according to claim 9 wherein the means for detecting includes a processing unit executing a control program for evaluating the detected control operation, generating the at least one signal and activating the means for wireless transmission to transmit the at least one signal.

14. An energy-autonomous elevator system control element comprising:

means for detecting a control operation, including means for wireless reception of a signal defining the control operation, where the control operation is selected by a user on a mobile phone and the signal is wirelessly transmitted from the mobile phone;

means for wireless transmission of at least one signal to a remote elevator system controller in response to detection of the control operation by the means for detecting; and an energy recovery unit supplying electrical power to the means for detecting and the means for wireless transmission wherein the control element operates without external wiring.

15. The energy-autonomous elevator system control element according to claim 14 wherein the energy recovery unit includes at least one induction coil configured to receive energy in the form of electromagnetic waves emitted from the mobile phone.

* * * * *